US005918941A

United States Patent [19]

Kigel

[11] Patent Number: 5,918,941

[45] Date of Patent: Jul. 6, 1999

[54] HEADREST MOUNTING ASSEMBLY FOR A CHAIR AND THE LIKE

[76] Inventor: Rudolf Kigel, 50 Ritin Lane, Unit 6, Concord, Ontario, Canada, L4K 4C9

[21] Appl. No.: 09/134,975

[22] Filed: Aug. 17, 1998

[51] Int. Cl.[6] ..... A47C 1/10

[52] U.S. Cl. ..... 297/410; 297/353

[58] Field of Search ..... 297/353, 391, 297/410, 463.1

[56] References Cited

U.S. PATENT DOCUMENTS

| | | | |
|---|---|---|---|
| 1,260,032 | 3/1918 | Perpick | 297/410 |
| 1,763,294 | 6/1930 | Emmert | 297/410 |
| 1,867,600 | 7/1932 | Schwarkopf | 297/410 |
| 3,877,751 | 4/1975 | Rasmussen | 297/410 |
| 4,012,158 | 3/1977 | Harper | 297/353 X |
| 4,451,084 | 5/1984 | Seeley | 297/410 X |
| 5,582,460 | 12/1996 | Schultz | 297/353 |
| 5,649,741 | 7/1997 | Beggs | 297/353 |

*Primary Examiner*—Laurie K. Cranmer
*Attorney, Agent, or Firm*—David W. Wong

[57] ABSTRACT

A headrest mounting assembly for mounting on the external surface of the rear surface of a backrest. The assembly includes a latching assembly removably mounted within a cover casing which has a channel defined by an upper slot opening and a lower slot opening formed in the upper and lower panels of the cover casing. A latching element pivotally mounted on a support and biassed by a torsion spring. The latching element has a narrow latching finger which is normally located in the locked position in the channel when the assembly is mounted on the backrest. The latching assembly bas a dome-shaped press button mounted on the latching element and it is operative to locate the latching finger in an opened position to allow the elongated bar of a headrest to be inserted through the channel. A plurality of transverse openings are formed in the elongated bar which are adapted to engage with the narrow finger of the latching element to lock the headrest at a selected height above the backrest.

3 Claims, 4 Drawing Sheets

HEADREST MOUNTING ASSEMBLY FOR A CHAIR AND THE LIKE

BACKGROUND OF THE INVENTION

This invention relates to a head rest assembly and particularly to a head rest assembly which is mountable on the external rear surface of the backrest of a chair and the like.

A common head rest assembly for a chair and the like is built integrally into the backrest during the fabrication of the latter. The assembly requires openings to be provided both at the upper edge and within the body of the backrest to accommodate the assembly as well as mounting means within the backrest to support the assembly therein. Thus, it is complex in construction and it is difficult and time consuming to fabricate. Furthermore, it also complicates the finishing process of the backrest since the outside cover of the backrest must be provided after the head rest assembly has been properly mounted into the backrest. Moreover, such type of head rest assembly is difficult to incorporate into an existing backrest since it would require substantial alterations to be made in the construction of the backrest to accommodate the assembly.

The above drawbacks are alleviated with an externally mounted head rest assembly. The simplest externally mounted head rest assembly comprises a rectangular casing mounted onto the rear surface of the backrest. The casing has an upper slot opening and an aligned lower slot opening through which an elongated bar on the top end of which the head rest is mounted, may be slidably inserted therethrough. The elongated bar is then mounted at any selected upwardly extending position with a hand operated set screw or bolt provided in the front of the casing. The casing of such head rest commonly has a welded construction in which its rear cover is welded to its front cover. Such welded construction is again time consuming and expensive to carry out. Furthermore, the elongated bar is invariably marred by the set screw in use such that the bar surface has an unpleasing appearing and worse still sharp edges may be formed on the marred surface by the set screw, which may cause injury to the user such as cutting of fingers or hand when adjusting the bar.

Another type of known externally mounted head rest assembly is provided with a spring-loaded latch assembly within a casing such that the head rest mounting elongated bar may be slidably inserted therethrough in selected position by operating the latch assembly. The latch assembly of such head rest assembly heretofore has been provided by a somewhat S-shaped casting iron latch element formed by expensive and time consuming molding process. The latch element is normally biassed by a compression spring in a locked position to lock the head rest mounting elongated bar at a selected position, and it may be depressed to an opened position to allow the elongated bar to be adjusted to any chosen position. All components within the casing of such assembly require to be welded in place; accordingly, it is also expensive and time consuming to produce.

SUMMARY OF THE INVENTION

It is a principal object of the present invention to provide an externally mounted headrest assembly which may be fabricated by engaging all component part together without welding.

It is another object of the present invention to provide a head rest assembly in which all component parts can be formed expeditiously with a stamping process.

It is yet another object of the present invention to provide a head rest assembly which may be incorporated in a backrest either during its fabrication or any time afterwards without requiring any alteration in the construction of the backrest.

DESCRIPTION OF THE DRAWINGS

Other object of the present invention will appear in the following description and appended claims, reference being made to the accompanying drawings in which

DETAILED DESCRIPTION OF THE PREFERRED EMBODIMENTS

Figure 2:
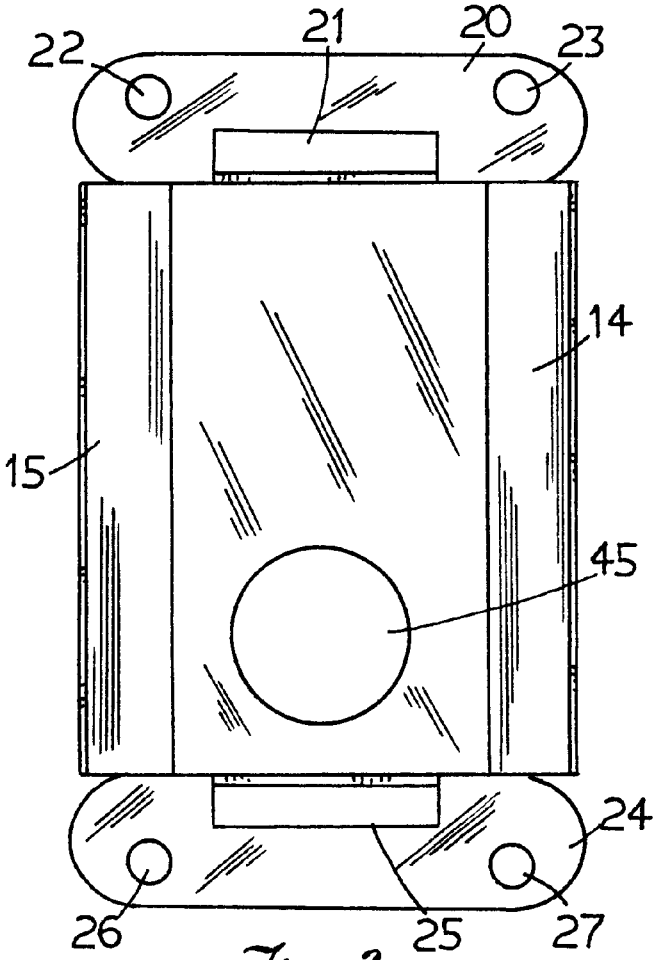
FIG. 2 is a perspective rear elevation view of the front cover of the head rest assembly.
Figure 5:
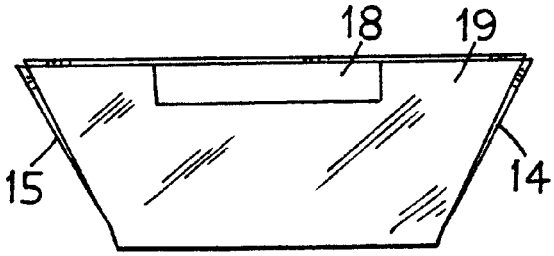
FIG. 5 is a perspective bottom elevation view of the front cover.

With reference to the drawings wherein like reference numerals designate corresponding parts in the several views, the head rest mounting assembly 10 according to the present invention has a mounting casing 11 which has a generally rectangular cover 12. The front surface 13 of the cover is generally flat, and the side panels 14 and 15 may be sloping outwardly and rearwardly to provide a pleasing appearance. A top slot opening 16 is formed at the center rear edge of the top panel 17 of the cover 12, and a bottom slot opening 18 is formed at the center rear edge of the bottom panel 19. The top slot opening 16 and the bottom slot opening 18 are aligned with each other. An integral upper extension wing 20 extends upwardly from the rear edge of the top panel 17, and the upper slot opening 16 has an extension upper slot 21 extending into the upper extension wing 20 as best shown in FIG. 2. Two mounting openings 22 and 23 are formed in the upper extension wing 20. Similarly, an integral bottom extension wing 24 extends downwardly from the rear edge of the bottom panel 19 and an extension lower slot opening 25 which is an extension of the bottom slot opening 18 is formed in the center bottom edge of the bottom extension wing 24. Two mounting openings 26 and 27 are formed in the bottom extension wing 24.

Figure 8:
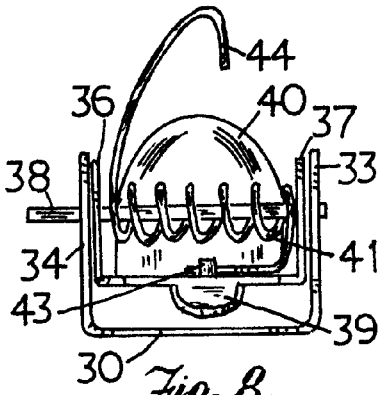
FIG. 8 is a perspective top elevation view of the latching assembly.
Figure 9:
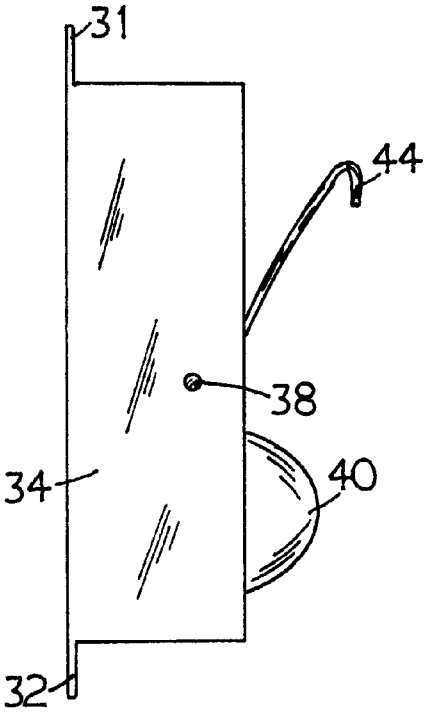
FIG. 9 is a perspective side elevation view of the latching assembly of FIG. 6.
Figure 7:
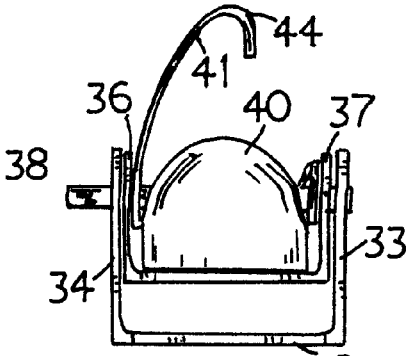
FIG. 7 is a perspective bottom elevation view of the latching assembly of FIG. 6.

The head rest mounting assembly 10 has a latching assembly 28 mounted on a support 29 which has a substantially U-shaped cross section as best shown in FIGS. 7 and 8. The support 29 has a rectangular base panel 30 which has a slightly narrower upper portion 31 and a similar lower portion 32. The total length of the rectangular base panel 30 plus the upper portion 31 and lower portion 32 is equal to the distance between the upper edge of the extension upper slot opening 21 in the upper extension wing 20 to the lower edge of the extension lower slot opening 25 in the lower extension wing 24 of the rectangular cover 12. Also, the width of the upper portion 31 of the support is equal to the width of the extension upper slot opening 21, and similarly, the width of the lower portion 32 of the support 29 is equal to the extension lower slot opening 25. The support 29 has two side walls 33 and 34. The width of the side walls 33 and 34 is equal to the depth of the cover 12.

Figure 6:
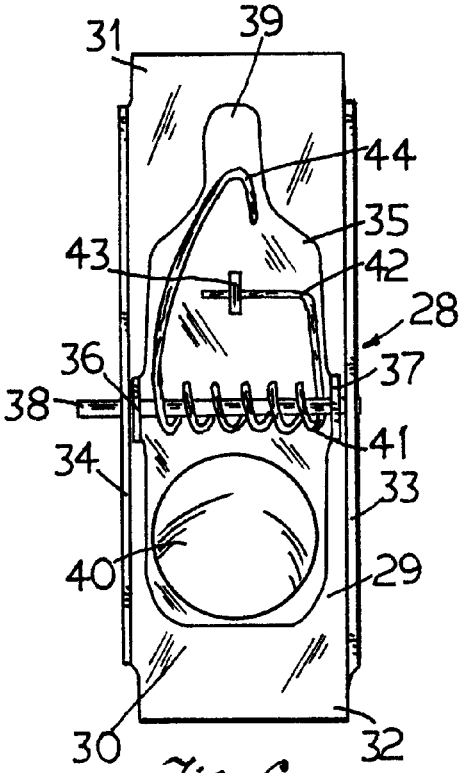
FIG. 6 is a perspective front elevation view of the latching assembly.
Figure 11:
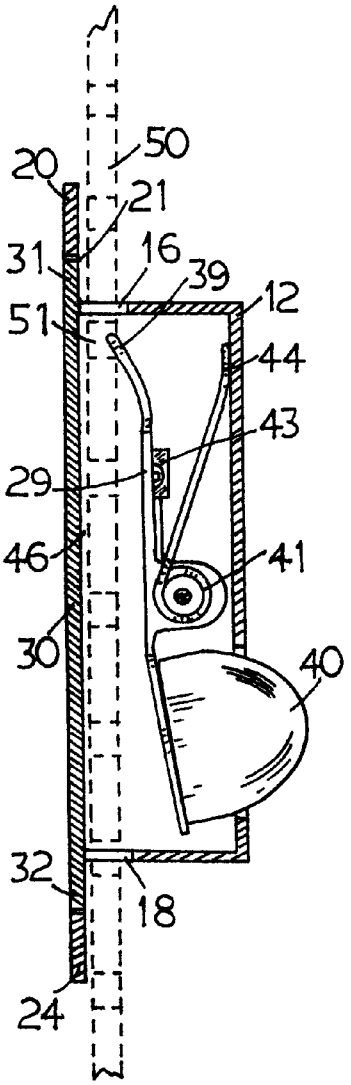
FIG. 11 is a partial sectional view of the head rest mounting casing assembly along section line XI—XI of FIG. 1.

A latching element 35 is pivotally mounted within the support 29. The latching element 35 may be made by stamping a steel plate to the shape as shown in FIG. 6. It has two side arms 36 and 37 extending perpendicularly to the base panel 30. An opening is formed in the two side arms 36 and 37 through which the latching element 35 is pivotally mounted to the support 29 by a shaft 38 with the latching element 35 spaced from the base plate 30; thus it allows the latching element 35 to pivot within the support 29 relative to the shaft 38. The front end portion of the latching element has a narrow finger 39 which curves slightly towards the base plate 30 of the support 39 when the latching element is mounted to the latter as best shown in FIGS. 8 and 11. A substantially dome-shaped press button 40 is mounted on the rear portion of the latching element 35. A torsion spring 41 is mounted on the shaft 38 with one end 42 therein mounted to a retaining tab 43 located on the latching element 35. The other free end 44 of the torsion spring 41 extends outwards from the support 29, thus depressing the free end 44 of the torsion spring 41 would cause the latching element 35 to locate in a normal locked position with the latching element 35 parallel to the base plate 30 of the support and the narrow finger 39 extending towards the base plate 30.

Figure 10:
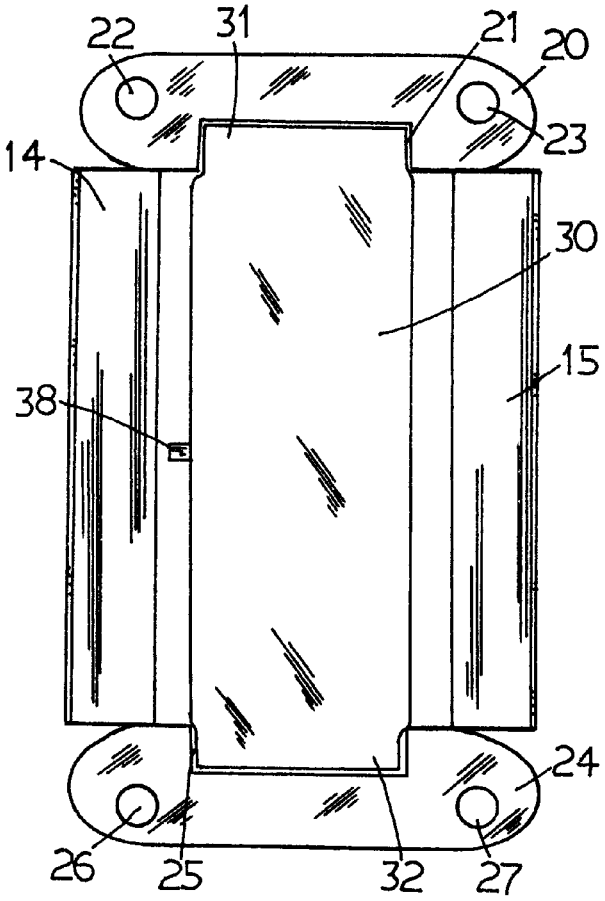
FIG. 10 is a perspective rear elevation view of the head rest mounting casing assembly.

With the construction as described above, the support 29 may be removably mounted to the cover 12 by simply engaging the upper portion 31 of the support 29 with the extension upper slot opening 21 of the cover 12 and the lower portion 32 of the support 29 with the extension lower slot opening 25 of the cover 12 as best shown in FIG. 10. Since the width of the side walls 33 and 34 of the support 29 is equal to the depth of the cover 12, the support 29 will lie flush within the cover 12. In this mounted position, the press button 40 extends outwards through a front opening 45 formed in the cover 12, and the space between the base plate 30 of the support 29 and the latching element 35 formed a channel 46 with the upper slot opening 16 as its upper opening and the lower slot opening 18 as its lower opening. The free end 44 of the torsion spring 41 will press against the cover 12 to locate the latching element 35 in the normal locked position with the narrow finger 39 located within the channel 46.

Figure 1:
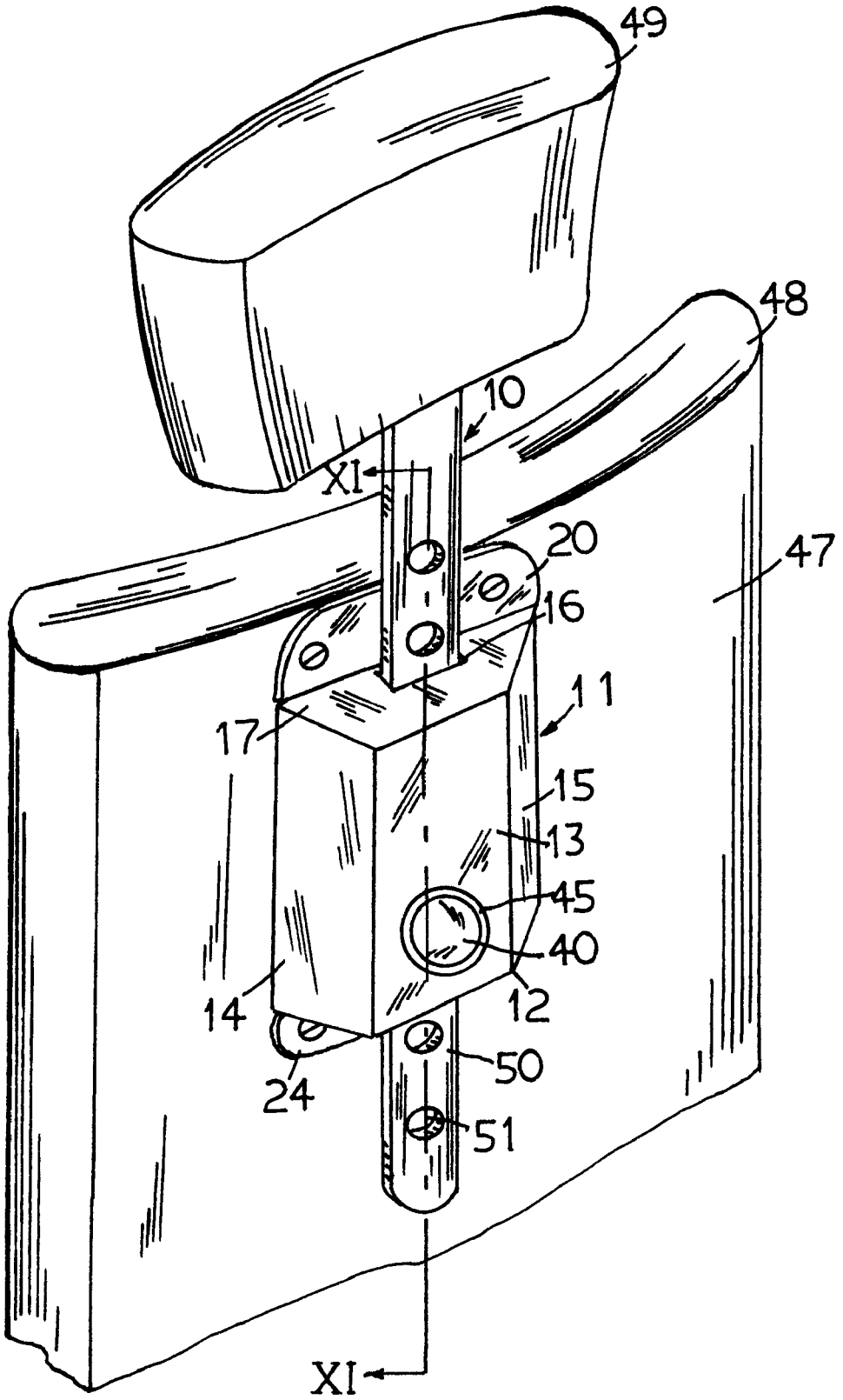
FIG. 1 is a general perspective isolated elevation view showing the head rest assembly of the present invention mounted on the rear surface of a backrest.
Figure 4:
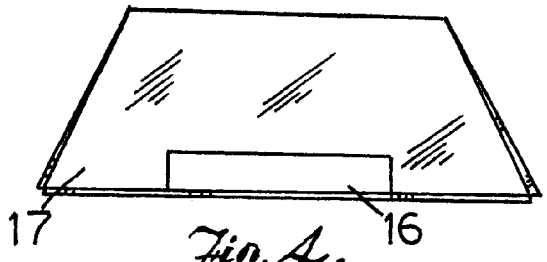
FIG. 4 is a perspective top elevation view of the front cover.
Figure 3:
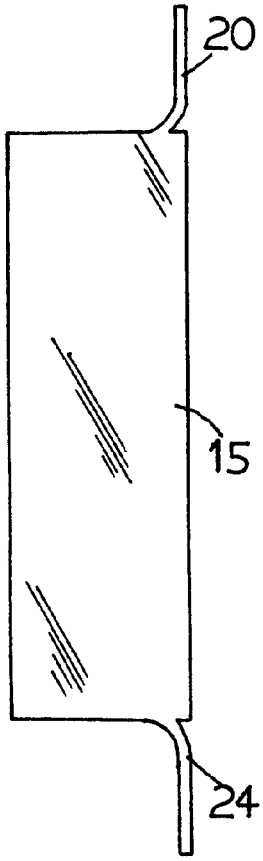
FIG. 3 is a perspective side elevation view of the front cover shown in FIG. 2.

The head rest mounting assembly 11 may then simply be mounted expeditiously to the external rear surface 47 of the backrest 48 as best shown in FIG. 1 with screws through the openings 22, 23, 26 and 27. A headrest 49 mounted on an elongated slide bar 50 may then be inserted through the channel 46 through its upper and lower openings by depressing the press button 40 against the force of the torsion spring 37 to clear the channel 46. Retaining openings 51 are formed on the slide bar 50 such that when the press button 40 is released, the narrow finger 39 of the latching element 35 will engage with a selected opening 51 to retain the slide bar 50 at a selected position so that the headrest 49 will be located at a chosen position above the backrest.

It will be appreciated by those skilled in the art that key components of the head rest mounting assembly of the present invention may be quickly and simply mounted together, and the assembly may then be mounted to the external surface of the backrest of a chair and the like with ease. It can be incorporated on an existing backrest without any alternation to the backrest.

Various modifications can be made without departing from the spirit of this invention or the scope of the appended claims. The head rest mounting assembly in this disclosure are given as examples and are in no way final or binding In view of the above, it will be seen that several objects of the invention are achieved and other advantages are obtained. As many changes could be made in the above construction and methods without departing from the scope of the invention, it is intended that all matter contained in the above description shall be interpreted as illustrative and not in a limiting sense.

I claim:

1. A headrest mounting assembly, for mounting on an external surface of a backrest, comprising:

a substantially rectangular front cover member having a top panel with a top slot opening formed therein, and a bottom panel with a bottom slot opening formed therein, said top slot opening and bottom slot opening being aligned with one another, said front cover member having a front opening formed therein, an integral top extension wing extending upwards from said top panel, an extension upper slot opening formed in said top extension wing, said extension upper slot opening forming an extension portion of said top slot opening, an integral bottom extension wing extending downwards from said bottom panel, an extension lower slot opening formed in said bottom extension wing, said extension lower slot opening forming an extension portion of said bottom slot opening, a latching assembly removably mounted within said front cover member, said latching assembly comprising, a support member having a substantially U-shape transverse cross section and having a base plate and two side panels extending perpendicular to said base plate, a latching element pivotally mounted to said side panels of said support member by a shaft member and spaced from said base plate, a torsion spring mounted on said shaft member and adapted to locate said latching element in a locked position, a press button mounted on said latching element and extending outwards from said front opening of said front cover, said extension upper slot opening and said extension lower slot opening being adapted to receive an elongated bar to be inserted therethrough, and said elongated bar having a headrest mounted on a top end thereof, said latching element having a narrow latching finger, and a plurality of transverse openings formed in said elongated bar, a selected one opening of said transverse openings being adapted to engage with said latching finger for retaining said headrest in a selected position above said backrest, and said base plate of said support member having a narrow upper portion and a narrow lower portion, and the total length of said base plate being equal to the distance between an upper edge of said extension upper slot opening to a lower edge of said extension lower slot opening.

2. A headrest mounting assembly according to claim 1 wherein said upper portion of said base plate is equal to the width of said extension upper slot opening, and said lower portion of said base plate is equal to the width of said extension lower slot opening.

3. A headrest mounting assembly according to claim 2 wherein said press button is a dome-shaped member mounted on said base plate.

* * * * *